US010174559B1

(12) United States Patent
Coast et al.

(10) Patent No.: US 10,174,559 B1
(45) Date of Patent: Jan. 8, 2019

(54) APPARATUS FOR SELECTIVE PLACEMENT OF AUGER OR ROD TYPE ANCHORS

(71) Applicants: John Stewart Coast, Baton Rouge, LA (US); John Burnett Coast, Baton Rouge, LA (US)

(72) Inventors: John Stewart Coast, Baton Rouge, LA (US); John Burnett Coast, Baton Rouge, LA (US)

( * ) Notice: Subject to any disclaimer, the term of this patent is extended or adjusted under 35 U.S.C. 154(b) by 0 days.

(21) Appl. No.: 15/878,643

(22) Filed: Jan. 24, 2018

Related U.S. Application Data

(60) Provisional application No. 62/449,820, filed on Jan. 24, 2017.

(51) Int. Cl.

| | |
|---|---|
| ***E21B 7/20*** | (2006.01) |
| ***E02F 3/96*** | (2006.01) |
| ***E02F 5/20*** | (2006.01) |
| ***E02D 5/80*** | (2006.01) |
| ***E04H 12/34*** | (2006.01) |
| ***E21B 7/00*** | (2006.01) |

(52) U.S. Cl.
CPC ..... *E21B 7/203* (2013.01); *E02D 5/801* (2013.01); *E02F 3/961* (2013.01); *E02F 5/20* (2013.01); *E04H 12/347* (2013.01); *E21B 7/005* (2013.01)

(58) Field of Classification Search
CPC ..... E21B 7/203; E21B 7/005; E02D 5/801; E02F 3/961; E03F 5/20; E04H 12/347
See application file for complete search history.

(56) References Cited

U.S. PATENT DOCUMENTS

| | | | | |
|---|---|---|---|---|
| 701,547 | A | 6/1902 | Davis | |
| 3,148,739 | A | 9/1964 | Mattingly et al. | |
| 3,181,623 | A * | 5/1965 | Lindgren | E21B 7/025 173/185 |
| 3,356,163 | A | 12/1967 | Rowe et al. | |
| 3,357,502 | A * | 12/1967 | Elliott | E21B 7/021 173/194 |
| 3,777,827 | A | 12/1973 | Thiery et al. | |
| 3,869,003 | A | 3/1975 | Yamada et al. | |
| 3,872,932 | A | 3/1975 | Gosselin | |
| 4,164,082 | A | 8/1979 | Watson | |
| 4,492,274 | A | 1/1985 | Schosek | |
| 4,499,698 | A | 2/1985 | Hoyt et al. | |
| 4,603,748 | A | 8/1986 | Rossfelder et al. | |
| 4,718,048 | A | 1/1988 | Staron et al. | |
| 4,785,892 | A * | 11/1988 | Luen | E02D 7/16 173/28 |
| 4,819,740 | A | 4/1989 | Warrington | |
| 5,040,926 | A | 8/1991 | Andreasson | |

(Continued)

*Primary Examiner* — Benjamin F Fiorello
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

An apparatus and method for selectively placing either an auger type or a ground rod or rod type anchor into the earth includes a machine frame that supports an elongated housing. The housing has upper and lower end portions. An anchor holder is positioned at the lower end of a tubular member rotatably mounted in the housing for holding an auger type anchor and rotating it during placement. If a ground rod or rod type anchor is selected, a drive that is offset from the housing central longitudinal axis drives the rod into the earth and without rotating the rod.

12 Claims, 9 Drawing Sheets

(56) References Cited

U.S. PATENT DOCUMENTS

| | | | | |
|---|---|---|---|---|
| 5,174,388 | A | 12/1992 | Williams et al. | |
| 5,213,449 | A | 5/1993 | Morris | |
| 5,355,964 | A | 10/1994 | White | |
| 5,549,168 | A | 8/1996 | Sadler et al. | |
| 5,584,603 | A | 12/1996 | Cortlever | |
| 5,725,329 | A * | 3/1998 | Chelminski | E02D 7/18 173/1 |
| 5,733,068 | A | 3/1998 | Reinert, Sr. | |
| 5,791,820 | A | 8/1998 | Rempel | |
| 5,811,741 | A | 9/1998 | Coast et al. | |
| 6,234,260 | B1 | 5/2001 | Coast et al. | |
| 6,305,882 | B1 | 10/2001 | Coast et al. | |
| 6,543,966 | B2 * | 4/2003 | White | E02D 11/00 175/55 |

* cited by examiner

APPARATUS FOR SELECTIVE PLACEMENT OF AUGER OR ROD TYPE ANCHORS

CROSS-REFERENCE TO RELATED APPLICATIONS

This application claims benefit of U.S. Provisional Patent Application Ser. No. 62/449,820, filed 24 Jan. 2017, which is hereby incorporated herein by reference.

Priority of U.S. Provisional Patent Application Ser. No. 62/449,820, filed 24 Jan. 2017, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the selective placement of either auger type anchors or rods (e.g., ground rods) into the earth and more particularly to an improved powered drive apparatus that selectively buries (partially or fully) an auger or a rod type anchor (or other rod or ground rod) into the earth. More particularly, the present invention relates to a method and apparatus for selectively placing either an auger or a ground rod type anchor partially into or fully below the earth's surface using an improved drive arrangement. The improved drive arrangement enables both rotation and linear (non rotating) drive while guiding the selected anchor during installation. The drive can use a series of gear driven drive rollers that are each shaped to grip the outer surface of a section of tubing with a rotary shaft inside the tubing and wherein a frame supports the gears and the drive rollers. In one embodiment, a vibratory motor or impact driver aids in driving the selected rod or anchor.

2. General Background of the Invention

Presently, a high torque drive mounted on a digger-derrick truck has been used to install auger type anchors in the utility industry. Auger type anchors are manually installed in remote areas (wetlands, swamps) using a handle or lever to rotate the anchor, since it is not possible to put very heavy equipment in such areas. This process is time consuming, labor intensive, and inefficient. Utility companies needed a way to drive ground rods in wetland areas. The only known existing commercially built ground rod drivers today are either large truck mounted units, which are designed to work in hard areas where the truck can be driven, or hand held units.

Some patents have issued that relate generally to drilling apparatuses, underground pipe or cable installation, vibratory earth boring systems, vibratory hammer/extractor devices, and methods of installing piling.

The Coast U.S. Pat. No. 6,305,882 is directed to rotary installation of an auger type anchor. The Coast U.S. Pat. No. 5,811,741 is directed to a system for installing a geophone. The Coast U.S. Pat. No. 6,234,260 is directed to a mobile drilling apparatus that can form boreholes in the earth. Each of these three Coast patents is hereby incorporated herein by reference.

The Thiery et al. U.S. Pat. No. 3,777,827, which is hereby incorporated herein by reference, discloses an apparatus for drilling a bore hole with a drill tool driven in rotation by a motor suspended from the end of a drill column constituted by a flexible drill pipe.

The Gosselin U.S. Pat. No. 3,872,932, which is hereby incorporated herein by reference, discloses a process that comprises progressively increasing the weight on the drill bit, determining the greatest value of the penetration rate of the drill bit during this period, progressively decreasing the weight on the drill bit when the penetration rate has reached a determined value and again progressively increasing the weight on the drill bit when the tension on the drill pipe has reached a fixed value. The passage from a period during which this weight decreased and vice-versa is achieved by varying the linear speed of the drill pipe at the ground surface, whereby the tension on the drill pipe is varied.

The Schosek U.S. Pat. No. 4,492,274, which is hereby incorporated herein by reference, relates to a light weight underground pipe or cable installing device adapted to be used in a narrow and deep operating trench. The Rossfelder et al. U.S. Pat. No. 4,603,748 discloses a vibrator system and a method for using a vibrator system to sink pipes or shape equipment. The prior art discussion contained in the '748 patent cites numerous patents and publications that relate in general to earth drilling, the sinking of piles, and pile driving.

The Staron et al. U.S. Pat. No. 4,718,048, which is hereby incorporated herein by reference, discloses a method of locating on drill pipe and ground recordings elementary recordings corresponding to one in the same depth level of the drilling tool, and grouping these elementary recordings in pairs, and then intercorrelating said recordings of the pairs so as to produce in respect of each pair a correlated signal which is representative of the acoustic energy produced and of the difference in travel times of the waves received on sensors from which the pair of recordings have been obtained.

A vibratory hammer and extractor apparatus is disclosed in the Warrington U.S. Pat. No. 4,819,740, which is hereby incorporated herein by reference.

The Andreasson U.S. Pat. No. 5,040,926, which is hereby incorporated herein by reference, relates to a pile which is intended to take compressive as well as tensile loads or to serve as a reinforcement member in soils. A pile is driven from a roller shaping unit by means of pressure in arbitrary directions into a mass of an earth layer. Upon attainment of the desired depth of penetration and/or pile length the pile is severed at or close to the upper surface of the earth layer.

A pile driving and/or pulling vibratory assembly with counter weights is disclosed in U.S. Pat. No. 5,355,964 issued to John White, which is hereby incorporated herein by reference.

The following table lists other possibly relevant patents, each of which is hereby incorporated herein by reference.

| U.S. Pat. No. | Title | Issue Date |
|---|---|---|
| 701,547 | WELL BORING APPARATUS | Jun. 3, 1902 |
| 3,148,739 | BORING APPARATUS WITH SCREW ANCHOR | Sep. 15, 1964 |

-continued

| U.S. Pat. No. | Title | Issue Date |
|---|---|---|
| 3,356,163 | SCREW ANCHOR INSTALLING METHOD AND APPARATUS | Dec. 5, 1967 |
| 3,777,827 | DRILLING APPARATUS | Dec. 11, 1973 |
| 3,869,003 | PILE DRIVERS | Mar. 4, 1975 |
| 3,872,932 | PROCESS AND APPARATUS FOR AUTOMATIC DRILLING | Mar. 25, 1975 |
| 4,164,082 | EXCAVATOR FOR ANCHOR HOLES | Aug. 14, 1979 |
| 4,492,274 | LIGHT WEIGHT UNDERGROUND PIPE OR CABLE INSTALLING DEVICE | Jan. 8, 1985 |
| 4,499,698 | METHOD AND APPARATUS FOR ANCHORING RETAINING WALLS AND THE LIKE, AND INSTALLATION THEREFOR | Feb. 19, 1985 |
| 4,603,748 | HIGH FREQUENCY VIBRATORY SYSTEMS FOR EARTH BORING | Aug. 5, 1986 |
| 4,718,048 | METHOD OF INSTANTANEOUS ACOUSTIC LOGGING WITHIN A WELLBORE | 016-05, 1988 |
| 4,819,740 | VIBRATORY HAMMER/EXTRACTOR | Apr. 11, 1989 |
| 5,040,926 | PILING METHOD | Aug. 20, 1991 |
| 5,174,388 | DRIVER TOOL AND METHOD | Dec. 29, 1992 |
| 5,213,449 | APPARATUS FOR INSERTING WICK DRAINS INTO THE EARTH | May 25, 1993 |
| 5,355,964 | PILE DRIVING AND/OR PIPE PULLING VIBRATORY ASSEMBLYWITH COUNTERWEIGHTS | Oct. 18, 1994 |
| 5,549,168 | PILE DRIVING APPARATUS | Aug. 27, 1996 |
| 5,584,603 | DRAINAGE WICK INSERTING DEVICE | Dec. 17, 1996 |
| 5,733,068 | METAL FOUNDATION PUSH-IT AND INSTALLATION APPARATUS AND METHOD | Mar. 31, 1998 |
| 5,791,820 | METHOD AND APPARATUS FOR IMPLANTING SCREW-IN PILINGS OR ANCHORS IN THE GROUND | Aug. 11, 1998 |
| 6,305,882 | APPARATUS FOR PLACING AUGER TYPE ANCHORS | Oct. 23, 2001 |

BRIEF SUMMARY OF THE INVENTION

The present invention relates to an improved method and apparatus for selectively placing either an auger type anchor or a rod (e.g., an electrical ground rod) partially or fully beneath the surface of the earth.

The present invention can be mounted on various vehicles, including those that are less intrusive of delicate habitat such as a marsh or swamp habitat. Thus, the present invention can be mounted on an air boat, amphibious marsh craft, or truck.

The present invention provides an apparatus for selectively placing auger type anchors or ground rods or like rods into or beneath the surface of the earth.

The apparatus includes a machine frame and an outer elongated housing having a longitudinal bore, the housing supported by the frame.

An elongated inner (rotatable) pipe can be carried within the housing bore, the pipe having upper and lower ends.

An anchor holder can be positioned at the lower end of the pipe for removably attaching to an auger type anchor to be placed or installed.

A housing drive mechanism can include one or more (e.g. a plurality of) wheels carried by the frame for transporting the housing between upper and lower positions, including preferably one or more wheels that frictionally grip the housing outer surface.

An elevating mechanism can be provided that moves the housing, the pipe, and anchor holder into an inclined position, and can be rotatable about a pivot.

A rotary drive can be provided for rotating the inner pipe and an attached auger type anchor. Rotation of the auger type anchor drives it into the earth.

A linear drive is preferably offset from the rotary motor drive and attached to the outer elongated housing with a specially configured bracket or support. The linear motor drive can include an impact or hammer drive portion that imparts hammer blows to the top of a ground rod to be inserted into the earth. The linear, offset drive can be a commercially available rotary impact driver tool such as Model HRD-58 by Greenlee Fairmont Company.

In one embodiment, the linear drive preferably includes a lower opening having a diameter greater than the diameter of the rod or ground rod to be installed.

In one embodiment, a laterally extending member or bracket preferably supports and spaces the linear drive away from the elongated housing.

In one embodiment, the laterally extending member or bracket preferably has a clamp that clamps to the outer elongated housing.

In one embodiment, the bracket also preferably clamps to the linear (offset) drive.

In one embodiment, the outer elongated housing can be a square tubing.

In one embodiment, a rotary pipe drive can be carried at an upper end of the elongated housing for rotating the inner pipe.

In one embodiment, the bracket can be attached to the outer elongated housing below the housing drive mechanism.

In one embodiment, upper idler wheels can be provided on opposite sides of the housing.

In one embodiment, an apparatus is provided for placing either auger type anchors or rods such as ground rods into the earth. The apparatus preferably includes a machine frame, an elongated outer housing supported by the machine frame, the outer housing preferably having an upper end and a lower end.

A tubular anchor holder can be contained within the housing, the anchor holder enabling an auger type anchor to be positioned at the lower end of the housing and in general alignment therewith.

A housing drive mechanism can include one or more drive wheels carried by the frame and in general alignment therewith, enabling the housing to be transported between upper and lower positions. The housing can contain an inner pipe.

A rotary motor drive can be provided for rotating the inner pipe and an attached auger type anchor.

A linear drive can be provided that is offset from the rotary motor drive. The linear drive can include a hammer arrangement that imparts hammer blows to the top of a ground rod to be inserted into the earth.

In one embodiment, an apparatus is provided for selectively placing either an auger type anchor or a ground rod into the earth. The apparatus includes a machine frame, a housing carried by the frame, the housing having an upper end portion and a lower end portion.

An anchor holder can be positioned at the lower end of the housing, the anchor holder including a disconnectable connection for connecting to an auger type anchor that is to be placed into the earth.

A linear drive can be provided that enables force to be applied to an elongated rod such as a ground rod. The linear drive is offset from the rotary drive with a specially configured bracket. The linear drive moves along a line generally collinear with the rod during installation of the rod into the earth.

The linear drive can be offset from the rotary motor drive and attached to the outer elongated housing, the linear motor drive can include a hammer blow mechanism that imparts hammer blows to the top of a ground rod to be inserted into the earth.

The present invention also includes a method of selectively installing a selected screw type anchor or a selected ground rod into the earth.

As part of the method, a machine is provided that includes a chassis supporting a moving frame portion with a rotary motor drive, a linear drive that grips the outer surface of the moving frame portion during use and wherein the linear drive has a linear drive axis, and an anchor holder for forming a disconnectable connection with a selected screw type anchor or ground rod to be installed, the moving frame portion having an outer surface.

A connection can be formed between the screw type anchor and the anchor holder.

The frame can be moved (e.g., pivoted) relative to the chassis so that the screw type anchor holder supports the anchor in a selected inclined position before installation.

A selected screw type or auger type anchor holder can be rotated while simultaneously thrusting it with the housing drive toward the earth so that the anchor enters the earth while rotating and while oriented in a selected inclined position.

As part of the method, a user might select a ground rod instead of an auger type anchor.

The ground rod can be thrust into the earth using the offset, linear drive wherein the ground rod has an axis that is laterally offset from the linear drive axis. A specially configured bracket spaces the offset, linear drive away from the rotary drive, both drives preferably always being available so that either a selected anchor or rod can be quickly installed.

BRIEF DESCRIPTION OF THE SEVERAL VIEWS OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
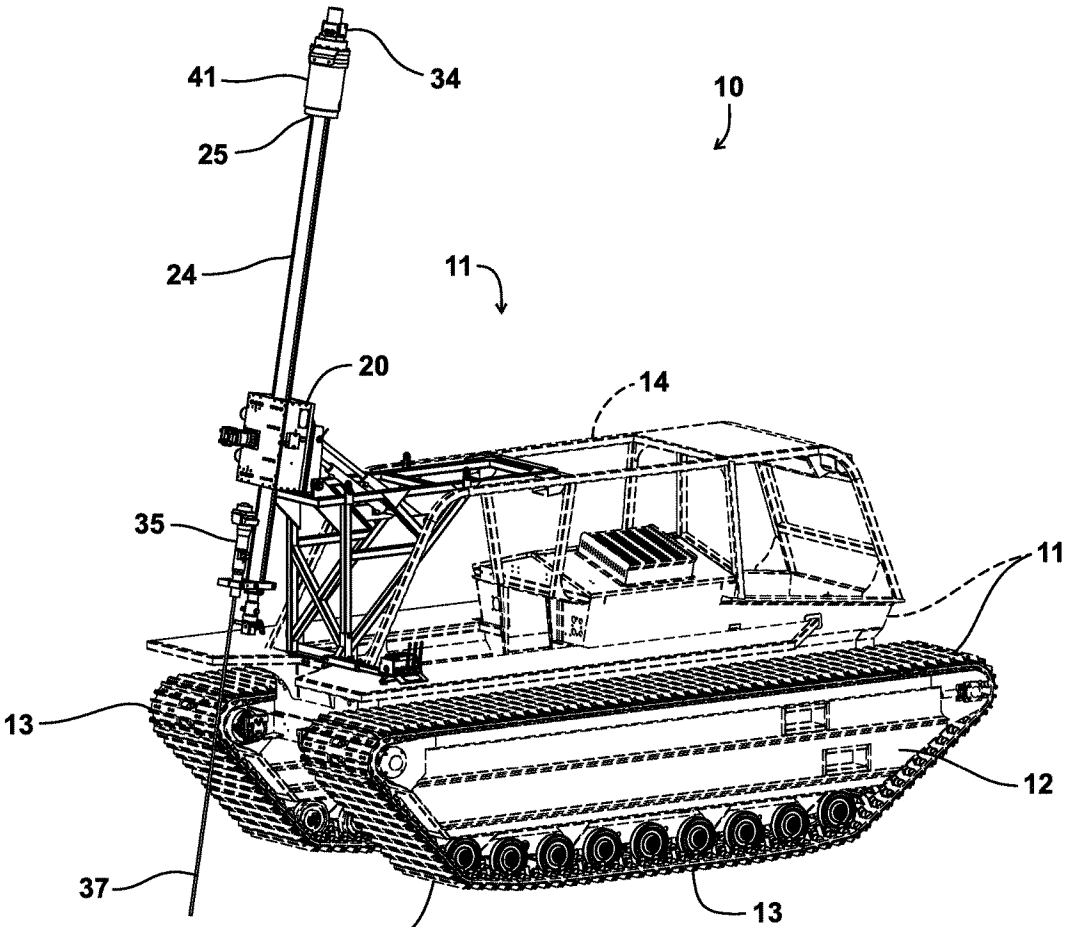
FIG. 1 is a perspective view of a preferred embodiment of the apparatus of the present invention.
Figure 4:
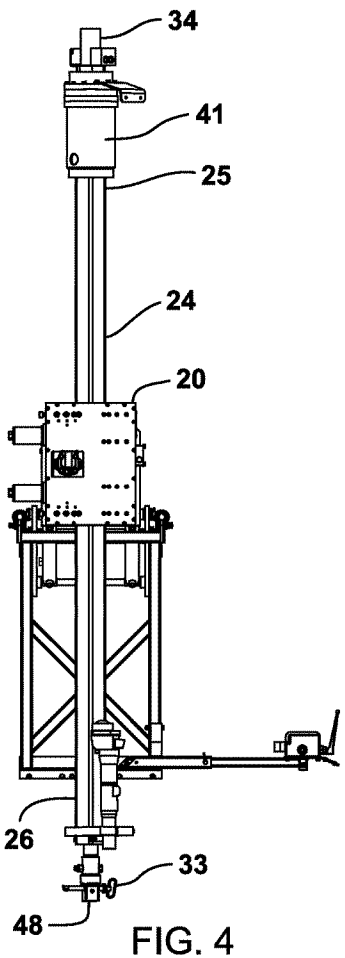
FIG. 4 is a partial front elevation view of a preferred embodiment of the apparatus of the present invention.

FIG. 1 shows a preferred embodiment of the apparatus of the present invention, designated generally by the numeral 10. Anchor placing apparatus 10 can be used to install either of two types of anchors/ground rods. These anchors can include an auger type anchor 27 and a rod or ground rod 37. FIGS. 1-10 show anchor setting apparatus 10 that can be mounted on a vehicle 11 such as a truck, marine vessel, amphibious marsh vehicle or the like. The vehicle 11 typically provides a chassis 12 and a plurality of wheels or tracks 13. Vehicle 11 can be an amphibious craft such as having spaced apart pontoons, endless tracks over the pontoons and cleats attached to the tracks (e.g., see the John Coast U.S. Pat. No. 4,961,395; U.S. Pat. No. 6,234,260; U.S. Pat. No. 6,305,882; which are each hereby incorporated herein by reference).

A superstructure 14 is shown provided on vehicle 11. Superstructure 14 can be a welded structural frame, for example, to which the apparatus 10 of the present invention is mounted. A telescoping cylinder 15 mounts upon frame 14 for moving elongated housing 24 in between a horizontal storage position and an inclined position. Plate 16 on superstructure 14 provides trunion or pivot 17 to which telescoping hydraulically powered cylinder 15 is anchored. The end of cylinder 15 opposite pivot 17 provides a telescoping or extendable pushrod 18 that preferably extends and retracts responsive to hydraulic, controlled fluid as shown by arrow 19 in FIG. 3, and for raising elongated housing 24 as shown by curved arrow 23 in FIG. 2. Pushrod 18 attaches to drive 20 at gusset plate 21 and pivot 22 so that gusset plate 21 pivotally connects to pushrod 18.

A linear housing drive 20 is provided for thrusting the elongated outer housing or square tube housing 24 downwardly. A rotary drive 34 can simultaneously rotate anchor 27. The linear drive 20 can be comprised of a plurality of support rollers and driven sheaves with a gear mechanism such as the one shown and described herein or the one shown and described in prior U.S. Pat. No. 5,811,741, which is hereby incorporated herein by reference.

In FIGS. 1-5 and 13, housing 24 provides and upper end portion 25 and a lower end portion 26. An auger or screw type anchor 27 is thrust into the earth 30 using a combination of rotational force provided by rotary motor drive 34 (with optional gear box 41) and linear force applied by the downward movement of elongated housing 24 driven by linear housing drive 20.

Figure 9:
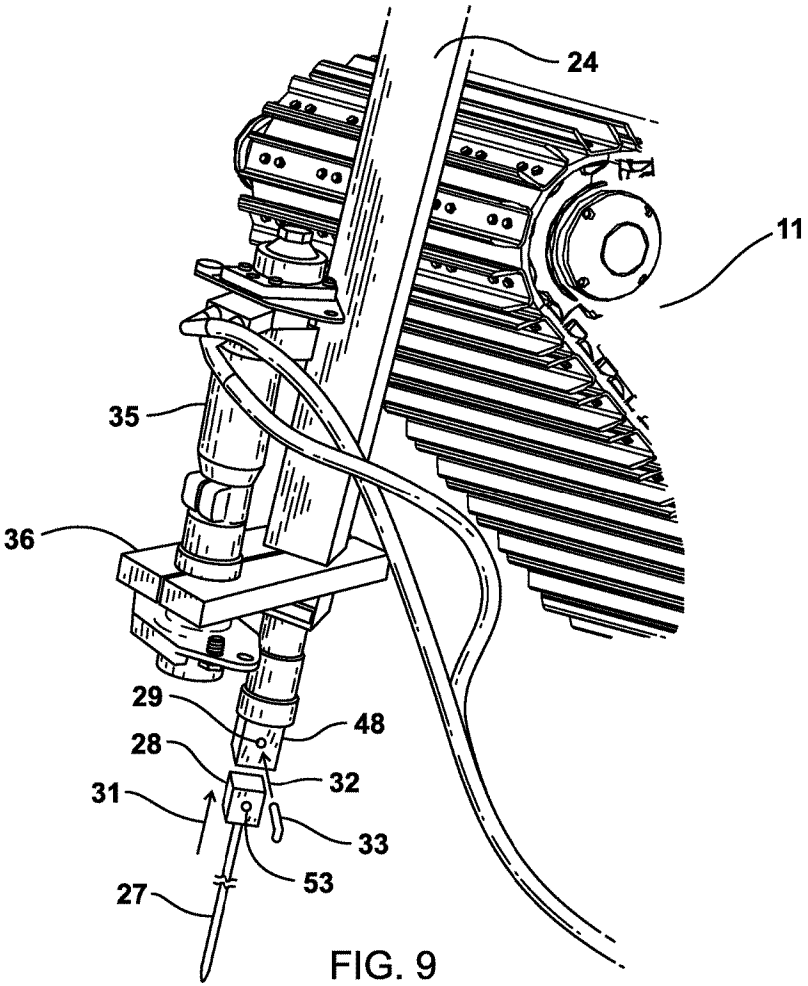
FIG. 9 is a fragmentary perspective view of a preferred embodiment of the apparatus of the present invention.
Figure 10:
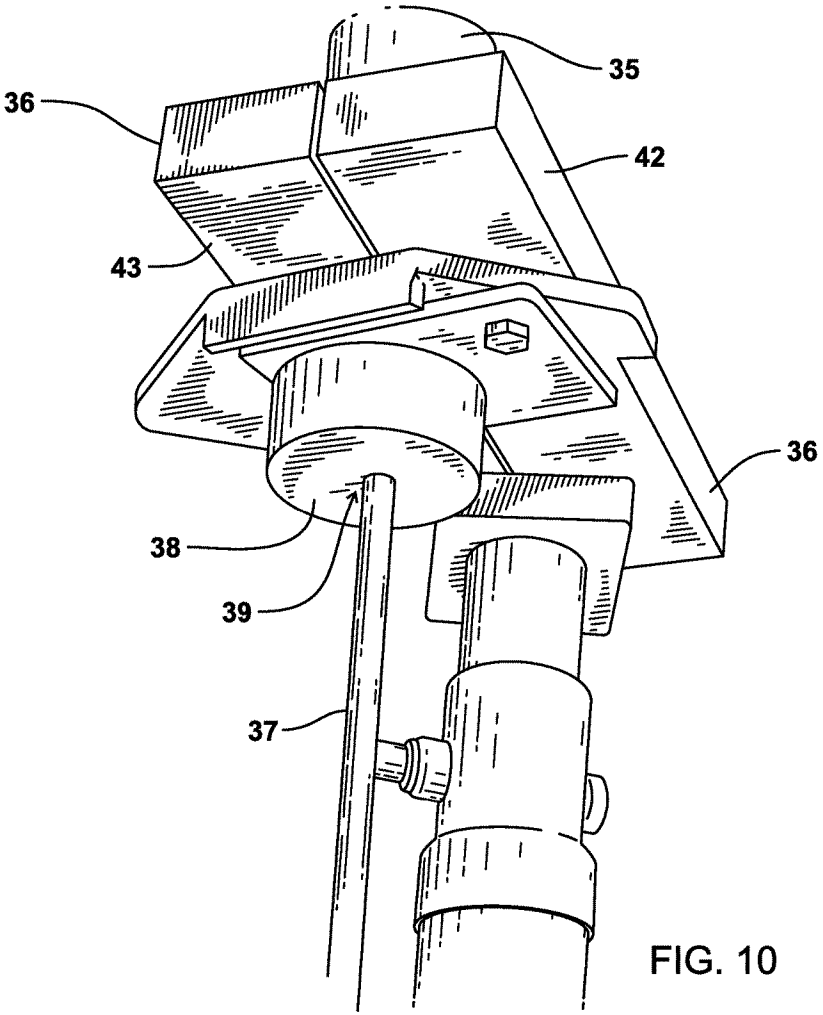
FIG. 10 is a top, fragmentary view of a preferred embodiment of the apparatus of the present invention.
Figure 11:
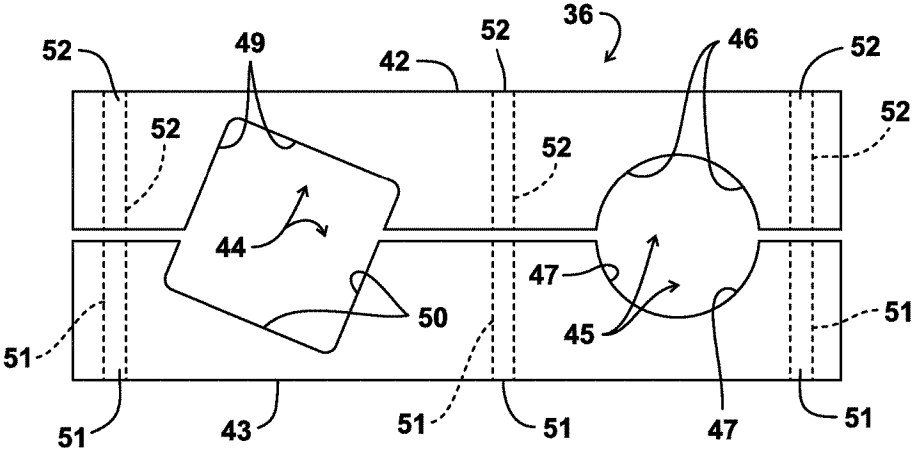
FIGS. 11-13 are fragmentary views showing the bracket/support that holds the impact driver.
Figure 12:
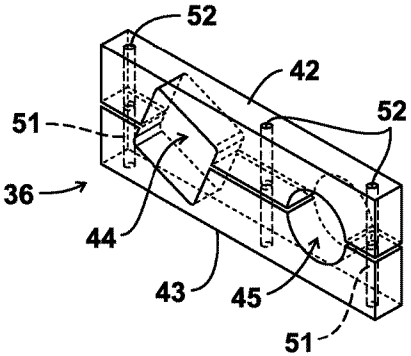
Figure 13:
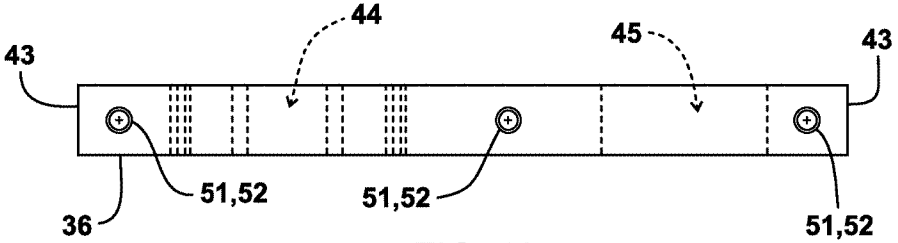

Auger type anchor 27 can have a square drive end at 28. It can be connected to elongated housing 24 at a square drive block 48 (see arrow 31 in FIG. 9). The square drive block 48 can provide a transverse opening 29 through which locking pin 33 (see arrow 32 in FIG. 9) can be placed. Before such an assembly of auger type anchor 27 to elongated housing 24, the square drive block 28 portion of auger type anchor 27 is preferably connected to square shaped drive 48. Once the square drive block 28 of auger type anchor 27 has been connected to square drive 48, locking pin 33 can be placed through transverse openings 29, 53 of the screw type anchor 27 and square tubing drive member 48 as shown in FIG. 9. A cotter pin can preferably be used to retain locking pin 33 in its locked position. Arrow 32 illustrates that locking pin 33 can be placed through aligned openings 29, 53 of square drive block 28 and square drive 48 of housing 24.

During insertion, linear motion is imparted to screw type anchor 27 while simultaneous rotary motion is imparted to screw anchor 27. Rotary motion is imparted to screw type anchor 27 by rotary motor drive 34 so that the combination of the linear drive 20 and rotary drive 34 moves the auger into the earth 30.

In FIGS. 1-9, there can be seen a linear drive or impact driver of the present invention designated by the numeral 35.

Figure 7:
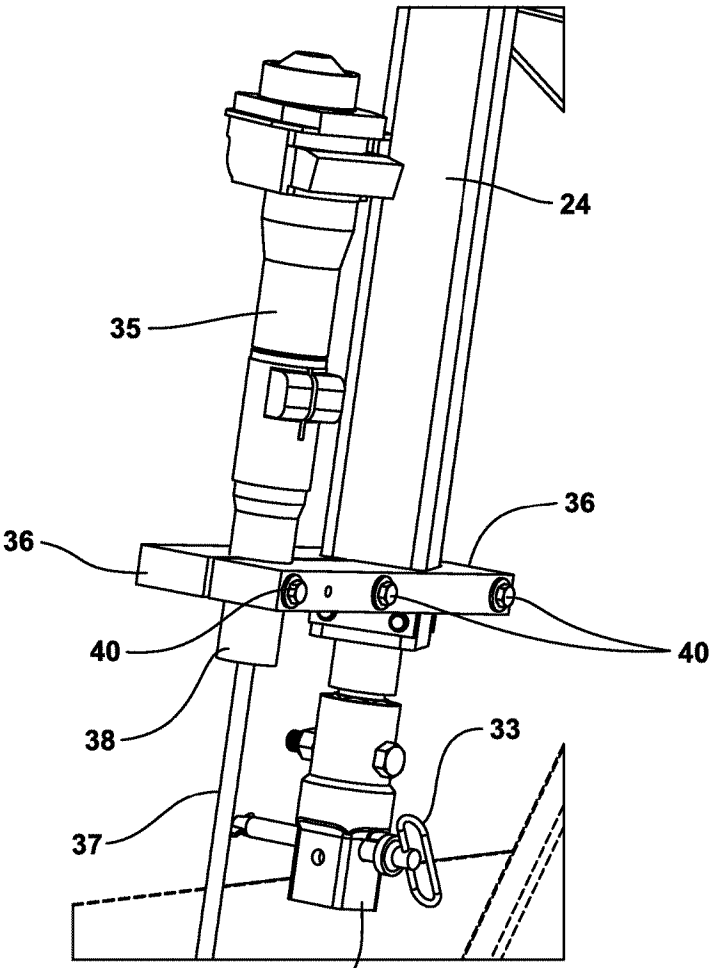
FIG. 7 is a fragmentary perspective view of a preferred embodiment of the apparatus of the present invention.
Figure 8:
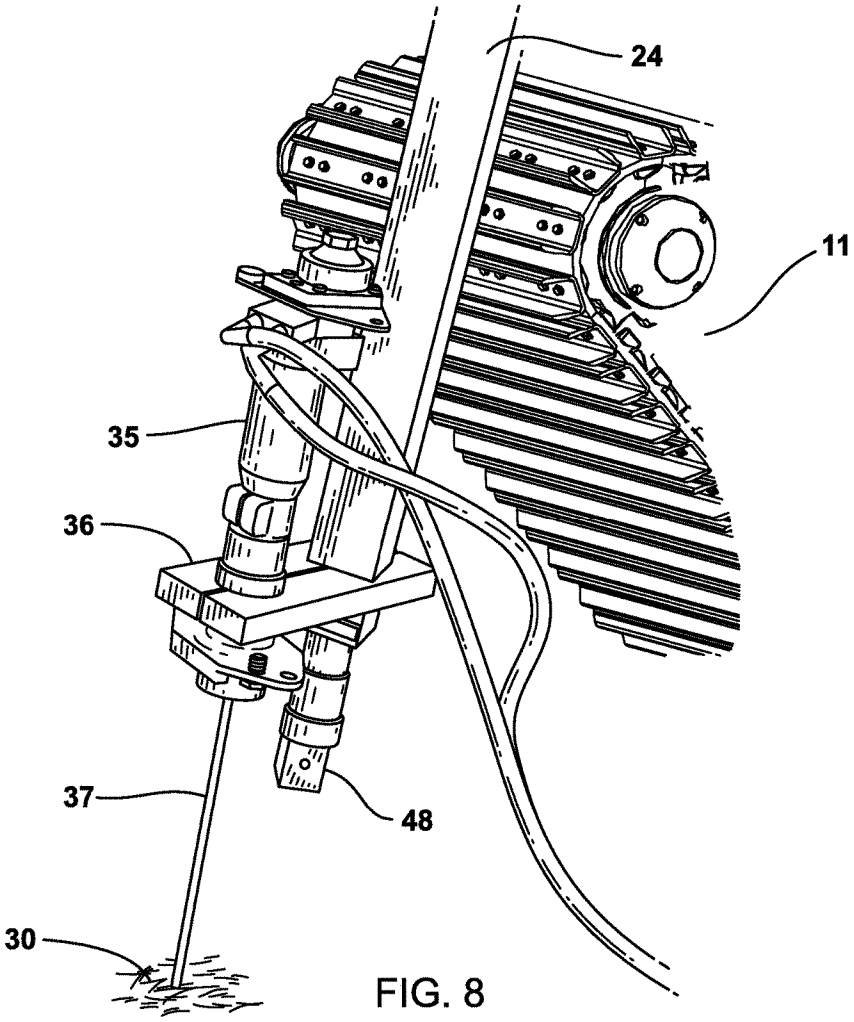
FIG. 8 is a fragmentary perspective view of a preferred embodiment of the apparatus of the present invention.

Linear drive 35 is preferably attached to elongated housing 24 with a specially configured bracket or support 36. Linear drive 35 can include an impact driver motor or vibratory motor (commercially available). The bracket 36 (see FIGS. 10-12) can be in the form of two bracket halves 42, 43. The combination of the bracket halves 42, 43, provide a clamping of housing 24 at opening 44 and a clamping of the linear drive or impact driver 35 at opening 45. For example, each of the halves 42, 43 of the bracket 36 can have a part of (e.g., one-half) of the opening 45 and a part (e.g., one-half) of the opening 44. In FIGS. 7-9, the bracket 36 clamps the drive or impact driver 35 at a circular portion thereof so that bracket half 42 has a semi-circular recess or opening 46 and bracket half 43 has a similarly configured semi-circular recess or opening 47. When bolted together, these semi-circular recesses or openings 46, 47 combine to provide a generally circular opening 45 that engages the cylindrically shaped outer surface of drive 35 as can be seen in FIGS. 6-12.

The bracket halves 42, 43 preferably provide recess or opening portions at 49, 50 that combine to provide a square opening 44 that is receptive of elongated housing 24. Each bracket half 42, 43 has openings receptive of bolts 40. Bracket half 43 has cylindrically shaped openings 51. Bracket half 42 has internally threaded openings 52. Bolts or bolted connections 40 are provided for bolting the bracket half 42 to the bracket half 43 and to provide a clamping action that holds the bracket 36 to the elongated housing 24. The clamping action of the bolted connection 40 clamps the bracket halves 42, 43 to the linear drive 35 at opening 45. Each bolt 40 passes through opening 51 and preferably forms a threaded connection with opening 52.

The drive 35 can provide a lower most end portion with a fitting 38 having a socket or opening or recess 39 that is receptive of an end portion of a rod 37 (for example, ground rod) that is to be thrust into the earth 30.

Figure 3:
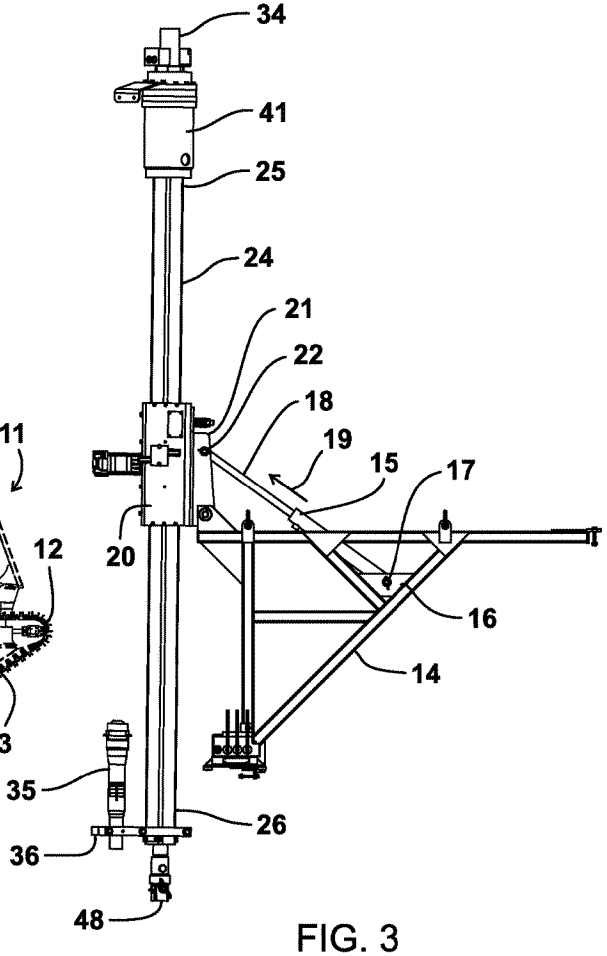
FIG. 3 is a partial side view of a preferred embodiment of the apparatus of the present invention.
Figure 2:
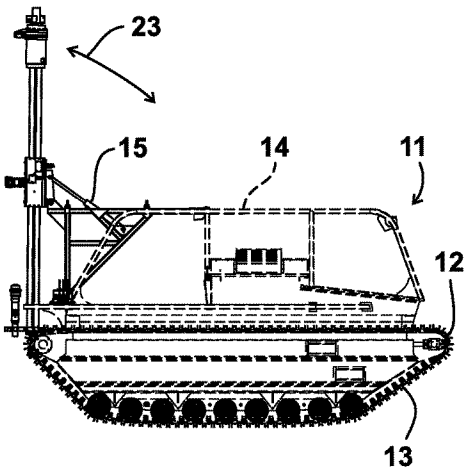
FIG. 2 is a side elevation view of a preferred embodiment of the apparatus of the present invention.
Figure 5:
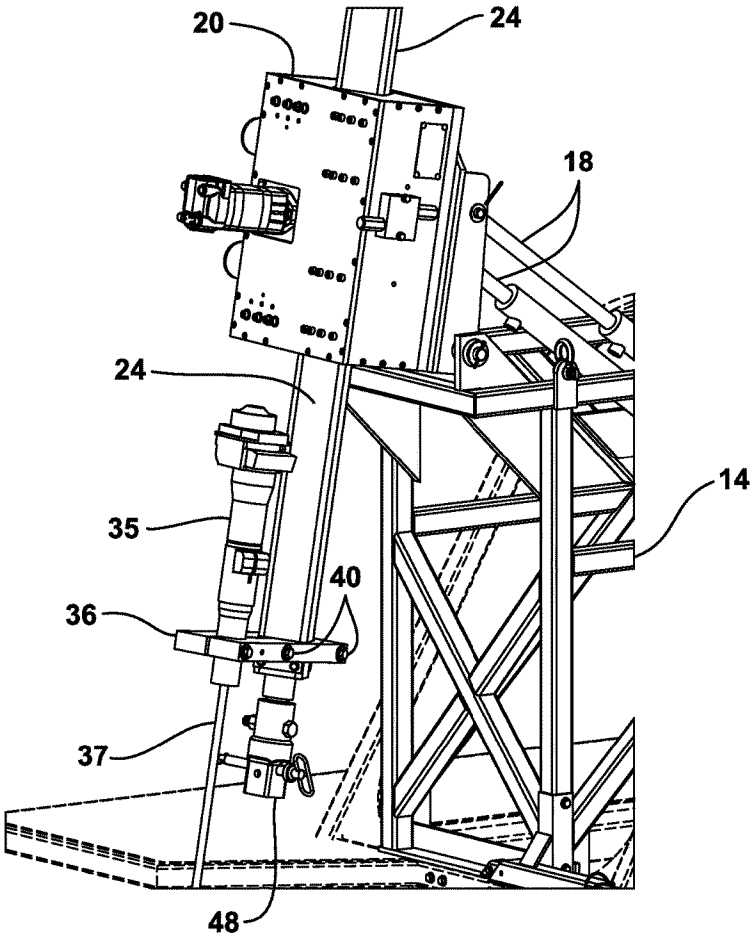
FIG. 5 is a partial perspective view of a preferred embodiment of the apparatus of the present invention.
Figure 6:
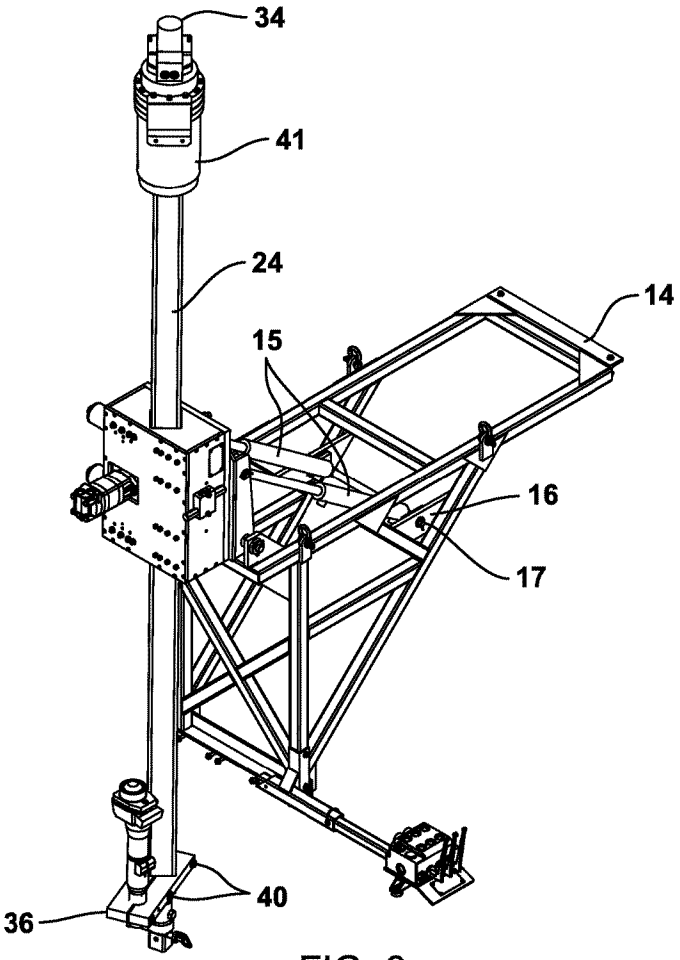
FIG. 6 is a partial perspective view of a preferred embodiment of the apparatus of the present invention.

The apparatus of the present invention thus provides an improved configuration for driving either an auger type anchor or an elongated rod 27 into the earth 30. By providing the drive 35 that is offset from the housing 24, the drive 35 does not interfere with the square drive 48 that is used to install an auger type anchor 27. Similarly, because of the offset arrangement as seen in FIG. 3, the housing 24 and square drive 48 that is used to install auger type anchors 27 does not interfere with the ability of the driver 35 to install a rod or ground rod 37 into the earth 30 as shown in FIGS. 3-5, 8-9.

The following table lists the parts numbers and parts descriptions as used herein and in the drawings attached hereto.

PARTS LIST:

| PART NUMBER | DESCRIPTION |
|---|---|
| 10 | anchor setting apparatus |
| 11 | vehicle/amphibious craft/truck |
| 12 | chassis |
| 13 | track/wheel |
| 14 | superstructure |
| 15 | telescoping cylinder |
| 16 | plate |
| 17 | pivot/pivot pin/trunion |
| 18 | pushrod |
| 19 | arrow |
| 20 | housing drive/linear drive |
| 21 | gusset/gusset plate |
| 22 | pivot |
| 23 | arrow |

-continued

PARTS LIST:

| PART NUMBER | DESCRIPTION |
|---|---|
| 24 | elongated housing |
| 25 | upper end |
| 26 | lower end |
| 27 | auger type anchor |
| 28 | square drive block |
| 29 | opening |
| 30 | earth |
| 31 | arrow |
| 32 | arrow |
| 33 | locking pin |
| 34 | rotary motor drive |
| 35 | drive/impact driver |
| 36 | bracket/support |
| 37 | rod/ground rod |
| 38 | fitting |
| 39 | socket/opening/recess |
| 40 | bolt/bolted connection |
| 41 | gear box |
| 42 | bracket half |
| 43 | bracket half |
| 44 | opening |
| 45 | opening |
| 46 | semi-circular recess/opening |
| 47 | semi-circular recess/opening |
| 48 | square drive/square drive block |
| 49 | recess/opening |
| 50 | recess/opening |
| 51 | cylindrically shaped opening |
| 52 | internally threaded opening |
| 53 | opening |

Because many varying and different embodiments may be made within the scope of the active concept herein taught, and because many modifications may be made in the embodiments herein detailed in accordance with the descriptive requirement of the law, it is to be understood that the details herein are to be interpreted as illustrative and not in a limiting sense.

The foregoing embodiments are presented by way of example only; the scope of the present invention is to be limited only by the following claims.

The invention claimed is:

1. An apparatus for selectively placing auger type anchors or rod type anchors beneath the surface of the earth, comprising:

a) a machine frame;

b) an outer elongated housing having a longitudinal bore, the housing supported by the frame;

c) an elongated inner pipe carried within the housing bore, the pipe having upper and lower ends;

d) an anchor holder positioned at the lower end of the pipe for removably attaching to an auger type anchor to be placed;

e) a housing drive mechanism that includes a plurality of wheels carried by the frame for transporting the housing between upper and lower positions, including at least some wheels that frictionally grip the housing outer surface;

f) an elevating mechanism for moving the housing, the pipe, and anchor holder into an inclined position;

g) a first motor drive for rotating the pipe and an attached auger type anchor; and h) a linear drive that is offset from said first motor drive and attached to said outer elongated housing, said linear drive including a mechanism that imparts hammer blows to a top portion of a ground rod to be inserted into the earth.

2. The apparatus of claim 1 wherein the linear drive includes a lower opening or socket having a diameter greater than the diameter of the ground rod to be installed.

3. The apparatus of claim 1 wherein a laterally extending member or bracket holds the linear drive away from the elongated housing.

4. The apparatus of claim 3 wherein the laterally extending member or bracket has a clamp that clamps to the outer elongated housing.

5. The apparatus of claim 4 wherein the bracket clamps to said linear drive.

6. The apparatus of claim 1 wherein the outer elongated housing is a square tubing.

7. The apparatus of claim 1 further comprising a rotary motor drive carried at an upper end of the elongated housing for rotating the inner pipe.

8. The apparatus of claim 1 wherein the laterally extending member or bracket is attached to the outer elongated housing below the housing drive mechanism.

9. The apparatus of claim 8 wherein upper idler wheels are on opposite sides of the housing.

10. An apparatus for selectively placing an auger type anchor or a rod type anchor into the earth, comprising:

a) a machine frame;

b) an elongated outer housing supported by the machine frame, the outer housing having an upper end and a lower end;

c) a tubular anchor holder contained within the housing, the anchor holder enabling an auger type anchor to be positioned at the lower end of the housing and in general alignment therewith;

d) a drive mechanism that includes one or more drive wheels carried by the frame and in general alignment therewith, enabling the housing to be transported between upper and lower positions;

e) a first motor drive for rotating the tubular anchor holder and the attached auger type anchor; and f) a linear drive that is offset from said first motor drive and that is removably connectable to a rod to be installed, said linear drive imparting hammer blows to a top portion of a ground rod to be inserted into the earth.

11. An apparatus for placing an auger type anchor into the earth, comprising:

a) a machine frame;

b) a housing carried by the frame, the housing having an upper end portion and a lower end portion;

c) an anchor holder positioned at the lower end of the housing, the anchor holder including a disconnectable connection for connecting to an anchor that is to be placed into the earth;

d) a first drive that enables force to be applied to the anchor holder along a line generally collinear with the auger;

e) a rotary motor drive for rotating the anchor holder during simultaneous linear insertion of the anchor with the first drive; and f) a linear drive that is offset from said first drive and attached to said housing, said linear drive including a hammer blow mechanism that impacts a top portion of a ground rod to be inserted into the earth.

12. A method of selectively installing a selected screw type anchor or a rod into the earth, comprising the steps of:

a) providing a machine that includes a chassis supporting a moving frame portion having an outer surface and having with a rotary motor drive, a first drive that grips the outer surface of the moving frame portion during use and wherein the first drive has a housing drive axis, an anchor holder having a pair of anchor engaging portions for forming a disconnectable connection with either a selected screw type anchor or a selected rod to be installed;

b) if a screw type anchor is selected, forming a connection between the screw type anchor and the anchor holder;

c) after step "b", moving the frame relative to the chassis so that the anchor holder supports the screw type anchor in a selected inclined position before installation;

d) simultaneously rotating a selected anchor holder and thrusting it with a linear drive toward the earth so that the anchor enters the earth while rotating and while oriented in a selected inclined position;

e) if a screw type anchor is not selected, selecting a ground rod; and f) thrusting the ground rod into the earth using the linear drive wherein the ground rod has an axis that is laterally offset from the housing drive axis.

* * * * *